US009428992B2

(12) United States Patent
Merron

(10) Patent No.: US 9,428,992 B2
(45) Date of Patent: Aug. 30, 2016

(54) METHOD AND APPARATUS FOR RESTRICTING FLUID FLOW IN A DOWNHOLE TOOL

(71) Applicant: Halliburton Energy Services, Inc., Houston, TX (US)

(72) Inventor: Matthew James Merron, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 273 days.

(21) Appl. No.: 13/958,122

(22) Filed: Aug. 2, 2013

(65) Prior Publication Data

US 2015/0034332 A1 Feb. 5, 2015

(51) Int. Cl.
*E21B 34/14* (2006.01)

(52) U.S. Cl.
CPC ..... *E21B 34/14* (2013.01)

(58) Field of Classification Search
CPC . E21B 34/066; E21B 34/08; E21B 2034/002
See application file for complete search history.

(56) References Cited

U.S. PATENT DOCUMENTS 3,211,232 A 10/1965 Grimmer
3,865,191 A 2/1975 Mott
4,510,994 A 4/1985 Pringle et al.
5,244,044 A 9/1993 Henderson
5,823,254 A 10/1998 Dobson et al.
6,155,350 A * 12/2000 Melenyzer ..... 166/374
6,896,049 B2 5/2005 Moyes
7,322,417 B2 1/2008 Rytlewski
7,416,029 B2 8/2008 Telfer et al.
7,464,764 B2 12/2008 Xu
7,581,596 B2 9/2009 Reimert et al.
7,628,210 B2 12/2009 Avant et al.
7,644,772 B2 1/2010 Avant et al.
7,661,478 B2 2/2010 Palmer et al.
7,681,650 B2 3/2010 Telfer et al.
8,863,853 B1 * 10/2014 Harris et al. ..... 166/386
2004/0163820 A1 8/2004 Bishop et al.
2007/0065125 A1 3/2007 Triplett et al.
2009/0044948 A1 2/2009 Avant et al.
2010/0065125 A1 3/2010 Telfer
2010/0132954 A1 6/2010 Telfer
2010/0212886 A1 8/2010 Hall
2011/0073321 A1 3/2011 Fay et al.
2011/0192607 A1 8/2011 Hofman et al.
2011/0278010 A1 11/2011 Fehr et al.
2011/0278017 A1 * 11/2011 Themig et al. ..... 166/373
2012/0181032 A1 7/2012 Naedler et al.
2012/0261115 A1 10/2012 Xu
2013/0025876 A1 * 1/2013 McCoy et al. ..... 166/373
2013/0048290 A1 2/2013 Howell et al.
2013/0153220 A1 6/2013 Carter et al.
2015/0000920 A1 * 1/2015 Harris ..... E21B 34/14 166/308.1

OTHER PUBLICATIONS

"International Application Serial No. PCT/US2014/049230, International Search Report mailed Nov. 28, 2014", 3 pgs.
"International Application Serial No. PCT/US2014/049230, Written Opinion mailed Nov. 28, 2014", 9 pgs.
"Australian Application Serial No. 2014296094, First Examiner Report mailed Mar. 16, 2016", 3 pgs.

* cited by examiner

*Primary Examiner* — William P Neuder
(74) *Attorney, Agent, or Firm* — Schwegman, Lundberg & Woessner, P.A.; John W. Wustenberg

(57) ABSTRACT

A ball seat valve employed in a downhole tool string includes a split-ring baffle that is configured to radially expand and to radially contract to catch a dropped ball.

19 Claims, 8 Drawing Sheets

METHOD AND APPARATUS FOR RESTRICTING FLUID FLOW IN A DOWNHOLE TOOL

BACKGROUND

This disclosure relates generally to ball-operated valves, and more specifically to such valves having a ball-receiving baffle, and to configurations for such baffles.

Subterranean well operations commonly employ valves at different locations along a wellbore for a variety of purposes. In some applications, downhole valves are employed to isolate sections of conduit within a wellbore. Such valves can be individually actuated opened/closed to isolate different portions of a string of conduits along the length of the wellbore. One type of valve employed in subterranean wells is a ball seat valve.

A typical ball seat valve has a bore or passageway that is restricted by a baffle forming a seat to receive a ball (which may literally be a spherical "ball" or in some examples may be another configuration of a plug or other mechanism that will engage the seat. The term "ball" as used herein, unless expressly indicated otherwise, refers to any sphere or other configuration of a plug intended to engage a baffle to close or substantially restrict a flow path through a tool. A ball can be dropped down the conduit within a wellbore to be disposed on the seat. Once the ball is seated, the fluid passage through the valve is closed and thereby prevents fluid from flowing through the bore of the ball seat valve, which, in turn, isolates the conduit section in which the valve is disposed. As the fluid pressure above the ball builds up, the conduit can be pressurized for any of a number of potential purposes, including for example, tubing testing, actuating a tool connected to the ball seat such as setting a packer, or fracturing particular layers of a formation through which the wellbore passes.

SUMMARY

Examples according to this disclosure include a split-ring baffle that can be employed in a ball seat valve in a conduit string of a wellbore. One example includes an apparatus for restricting fluid flow through a downhole tubular member. The apparatus, e.g., a ball seat valve, includes an annular sleeve and a resilient split-ring baffle. The annular sleeve is configured to be received within an annular housing and has an inner surface defining a first section of a first diameter and a second section of a second, smaller, diameter. The split-ring baffle is at least partially received within the sleeve. The baffle includes a longitudinal seam forming two separate circumferential ends in the baffle. The baffle is also longitudinally moveable between a first position in the first section and a second position in the second section of the sleeve. An outer surface of the baffle is configured to engage the inner surface of the sleeve to cause the baffle, when in the first position to be relatively radially expanded, and, when moved to the second position in the sleeve, to radially contract.

The details of one or more examples of the disclosure are set forth in the accompanying drawings and the description below.

DETAILED DESCRIPTION

Figure 1:
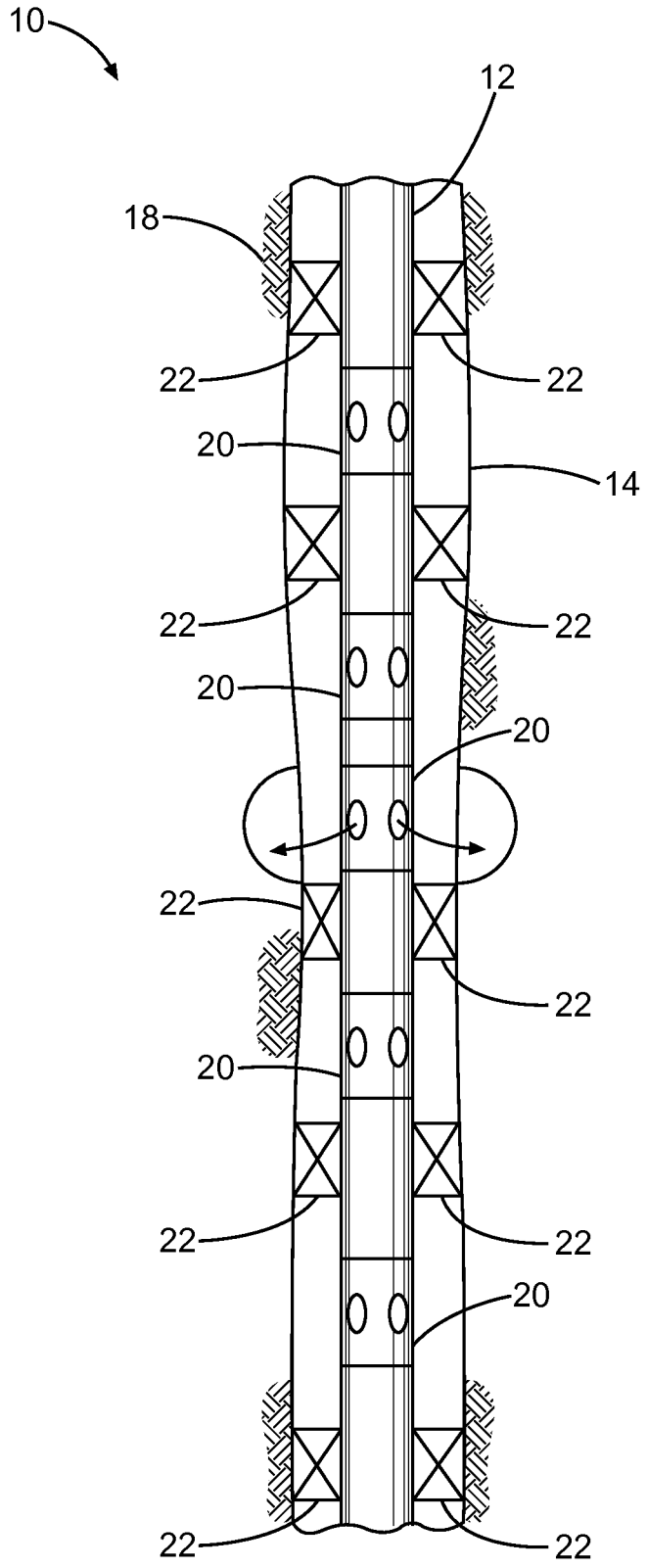
FIG. 1 schematically depicts an example fracturing system including a tool string arranged within a wellbore that passes through a number of layers of a formation of a well.

As noted above, ball seats can be employed to isolate different layers of a formation for fracturing. A fracturing system commonly includes pumps that pressurize fracturing fluid, which may be communicated downhole via the central passageway of a string of conduits disposed within a wellbore. The string can include sections with ball seat valves that are aligned with different layers of the formation. Opening and closing the ball seat valves at different locations along the string is used to control fluid flow between the central passageway of the string and different layers of the formation. For example, a ball seat can be actuated to isolate a particular section of conduit aligned with a target layer of the formation. In combination with actuating the ball seat, one or more apertures in the conduit above the ball seat can be opened or exposed to allow fracturing fluid to pass through the conduit into the target layer of the formation.

In practice, a ball seat valve can be activated by dropping a ball into the string from the surface of the well. The dropped ball descends through the conduit within the wellbore until it lodges in the seat of the valve. After the ball lodges in the ball seat, fluid flow through the central passageway of the string becomes restricted, a condition that allows fluid pressure to be applied from the surface of the well for purposes of exerting a downward force on the ball. The ball seat typically is attached to a sleeve of the valve to transfer the force to the sleeve to cause the valve to open. However, in other examples, the seating of the ball in the ball seat and the fluidic isolation of the associated zone of the tool string is separate from opening of the valve to allow fluid to pass through the tool string housing into the surrounding formation. For example, a separate sleeve within the tool string conduit can be actuated, e.g., moved axially to expose apertures in the tool string conduit. Once the valve has been opened, fracturing fluid can be transmitted through the string of conduit to one or more apertures opened/exposed by the value to carry out fracturing operations on a portion of the formation aligned with the ball seat valve. Thus, seating the ball in the ball seat fluidically isolates a particular zone of the wellbore and the valve is then opened to allow fracturing fluid to pass through the tool string conduit into a particular region of the formation.

A fracturing system can employ multiple ball seat valves to form multiple zones along the length of the wellbore. The zones of the wellbore can be used to target different layers of a formation for fracturing operations. In some fracturing systems, the valves may contain many different size ball seats to enable remote operation of the ball seat valves from the surface of the well. For example, to target and actuate the valves, differently sized balls may be dropped into the string from the surface of the well. Each ball size may be uniquely associated with a different valve, so that a particular ball size is used to actuate a specific valve. The smallest ball commonly opens the deepest valve. The ball seats of the string have different diameters, which are respectively associated with the different sized balls.

In systems employing multiple ball seat valves of varying size, the annular area that is consumed by each ball seat along the string restricts the cross-sectional flow area through the string (even in the absence of a ball), and the addition of each valve (and ball seat) to the string further restricts the cross-sectional flow area through the central passageway of the string, as the flow through each ball seat becomes progressively more narrow as the number of ball seats increase. Thus, a large number of valves may significantly restrict the cross-sectional flow area through the string.

To address the issue of progressively more restriction to the conduit of the string, multiple ball seat valves of the same size can be employed, in which the seat of each valve is configured to expand and contract such that the seat can selectively catch a dropped ball or allow the ball to pass down the string to the next valve. In other words, adjustable ball seat valves can be employed that are capable of being expanded to larger diameters and contracted to smaller diameters. The seat of a ball seat valve is, more generally, a baffle, configured to receive a ball (or other plug, as noted earlier herein) to substantially block movement of fluids through the conduit of the wellbore.

Examples according to this disclosure include a split-ring baffle that can be employed in a ball seat valve in a conduit string within a wellbore. One example includes an apparatus for restricting fluid flow through a downhole annular member. The apparatus, e.g., a ball seat valve, includes an annular sleeve and a resilient split-ring baffle. The annular sleeve is configured to be received within an annular housing and has an inner surface defining a first section of a first diameter and a second section of a second, smaller, diameter. The split-ring baffle is at least partially received within the sleeve. The baffle includes a longitudinal seam forming two separate circumferential ends in the baffle. The baffle is also longitudinally moveable between a first position in the first section and a second position in the second section of the sleeve. An outer surface of the baffle is configured to engage the inner surface of the sleeve to cause the baffle, when in the first position to be relatively radially expanded, and, when moved to the second position in the sleeve, to radially contract.

Example split-ring baffles in accordance with this disclosure may provide a number of advantages. For example, split-ring baffles in accordance with this disclosure provide a simple and low cost (e.g. both material and manufacturing) component that can include a relatively short length to reduce the overall size of a tool including the baffle. Additionally, the baffle only includes one junction to seal and which reduces interaction between the baffle and materials transmitted through the tool string conduit. The baffle can include support structures for reducing the likelihood of deflection and to lock the baffle into at least one position relative to the sleeve of the valve. The baffle can be re-expanded to the full internal diameter of the sleeve and is capable of being contracted and re-expanded multiple times without significant impacts on function.

Split-ring baffles in accordance with this disclosure are described as employed as part of a ball seat valve used to isolate and target layers of a formation during fracturing operations. However, split-ring baffles and ball seat valves in accordance with this disclosure can be employed in other applications. For example, a ball seat valve including a split-ring baffle in accordance with this disclosure can be employed to catch a dart employed for positive displacement in cementing applications, to set mechanical packers, as part of a shut-off collar at the toe of the tool in cementing applications, and in conjunction with liner hangers.

FIG. 1 is a schematic illustration of fracturing system 10 including tool string 12 arranged within wellbore 14, which passes through a number of layers of formation 18 of the well. Tool string 12 includes a number of ball seat valves 20 in accordance with this disclosure. Tool string 12 also includes a number of packers 22. Packers 22 seal off an annulus formed radially between tool string 12 and wellbore 14. Packers in this example are designed for sealing engagement with an uncased or open hole wellbore 14, but if the wellbore is cased or lined, then cased hole-type packers may be used instead. Swellable, inflatable, expandable, and other types of packers can be used, as appropriate for the well conditions, or no packers may be used.

In the FIG. 1 example, ball seat valves 20 permit selective fluid communication between the central passageway of tool string 12 and each section of the annulus isolated between two of the packers 22, which are located above and below each of the valves in wellbore 14. Each such section of the annulus surrounding tool string 12 is in fluid communication with a corresponding earth formation zone or layer of formation 18. Of course, if packers 22 are not used, then ball seat valves 20 can be placed in communication with the individual zones by other mechanisms, for example, with perforations, etc.

The zones of formation 18 can be, for example, sections of the same formation, or they may be sections of different formations. Each zone may be associated with one or more of ball seat valves 20. In order to carry out a fracturing operation on a particular one of the zones of formation 18, the associated ball seat valve 20 can be opened to allow communication between the central passageway of tool string 12 and the associated zone.

For example, one of ball seat valves 20 can be activated by dropping a ball into tool string 12 from the surface of the well. The dropped ball descends through the conduit forming string 12 within wellbore 14 until it lodges in a seat of valve 20. In one example, ball seat valve 20 includes an annular sleeve and a resilient split-ring baffle that functions as the ball seat of valve 20. The split-ring baffle of ball seat valve 20 is at least partially received within the sleeve. An outer surface of the baffle is configured to engage the inner surface of the sleeve to cause the baffle, when in a first position to be relatively radially expanded, and, when moved to a second position in the sleeve, to radially contract.

After the ball lodges in the ball seat, fluid flow through the central passageway of tool string 12 becomes restricted, a condition that allows fluid pressure to be applied from the surface of the well for purposes of exerting a downward force on the ball. Additionally, after the ball lodges in the ball seat, ball seat valve 20 can be opened to allow communication between the central passageway of tool string 12 and the associated zone of formation 18. In one example, a sleeve is located within tool string 12 above the split-ring baffle in which the ball is seated. The sleeve can be configured to be actuated to move axially within the outer conduit of tool string 12 to expose one or more apertures in the conduit. In another example, the ball seat is attached to a sleeve of ball seat valve 20 to transfer the force generated by fluid pressure in the central passageway of tools string 12 to the sleeve to cause the sleeve to move within the housing, thereby opening the valve.

Once ball seat valve 20 has been opened, fracturing fluid can be transmitted through conduit of tool string 12 to one or more apertures opened/exposed by valve 20 to carry out fracturing operations on a particular zone of formation 18 aligned with ball seat valve 20. Thus, seating the ball in the ball seat of ball seat valve 20 fluidically isolates a particular zone of wellbore 14 and thereafter valve 20 is opened to allow fracturing fluid to pass through the sleeve into a particular portion of formation 18.

In some cases, when tool string 12 is run downhole, all of ball seat valves 20 are initially closed. In one example, thereafter, ball seat valves 20 are successively opened one at a time in a predetermined sequence for purposes of fracturing layers of formation 18. For example, ball seat valves 20 are opened in a sequence that begins at the bottom of tool string 12, proceeds uphole to the next immediately adjacent valve 20, then to the next immediately adjacent valve 20, etcetera.

For purposes of opening a particular valve 20, a free-falling or forced plug is deployed from the surface of the well into the central passageway of tool string 12. In the following examples, the dropped plug is described and illustrated as a spherical ball. However, other plug types, e.g., differently-shaped plugs may be used.

In one example, the balls deployed for different ball seat valves 20 within tool string 12 can have the same diameter. In another example, some or all of the balls can have different diameters. As noted, initially, all of ball seat valves 20 can be closed, and none of split-ring baffles of valves 20 are in a contracted, ball catching state. When in the ball catching state, the split-ring baffle of valve 20 forms a seat that presents a restricted cross-sectional flow passageway to catch a ball that is dropped into the central passageway of tool string 12. Unopened ball seat valves 20 that are located above the opened or unopened valve 14 with the split-ring baffle in the contracted, ball-catching state allow the ball to pass through the conduit of tool string 12.

Figure 2:
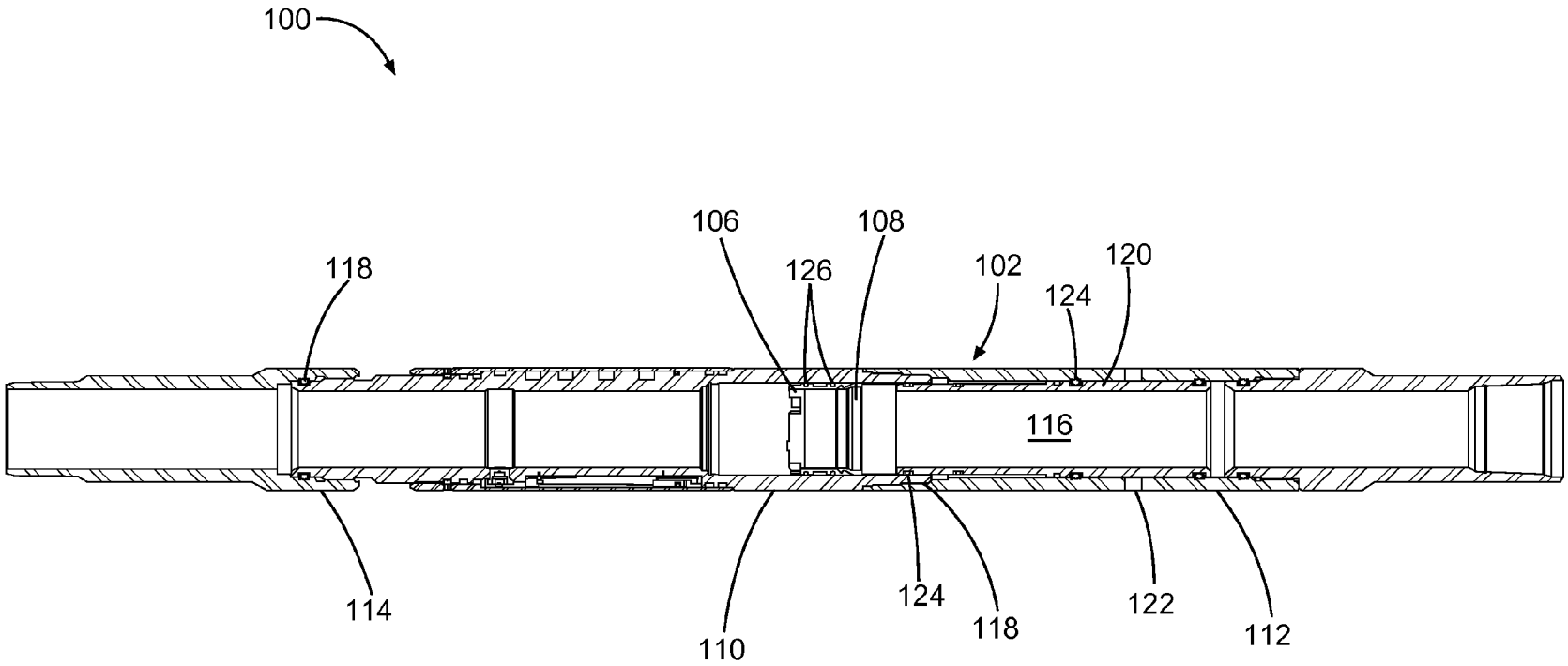
FIG. 2 depicts a section view of a portion of a tool string including an example ball seat valve in accordance with this disclosure.

FIG. 2 is a section view of a portion of tool string 100 including example ball seat valve 102. In the example of FIG. 2, ball seat valve 102 includes sleeve 106 and split-ring baffle 108. Sleeve 106 of ball seat valve 102 is received within housing 110, which forms a portion of the central conduit of the tool string 100.

Tool string 100 includes a number of sections defined by different cylindrical housings connected to one another. The example of FIG. 2 shows only a portion of tool string 100 and it is noted that tool string 100 can include a number of additional portions, one or more of which can include additional ball seat valves in accordance with this disclosure, similar to example tool string 12 and ball seat valves 20 illustrated in FIG. 1.

In FIG. 2, tool string 100 includes housing 110, within which sleeve 106 of ball seat valve 102 is arranged. Housing 110 is coupled above to upper housing 112 and below to lower housing 114. Housings of tool string 100, including housings 110, 112, and 114, can be coupled to one another in a variety of ways, including, e.g., threaded or spline connections, interference fits, and other mechanisms for connecting such components. Housings 110, 112, and 114 form a hollow generally cylindrical casing of tool string 100 that defines central conduit 116, by which fluids can be communicated from the surface, down a wellbore within which tool string 100 is deployed.

Housings 110, 112, and 114, as well as other components of tool string 100 like sleeve 106 can be sealed to one another employing various types of sealing mechanisms configured to inhibit ingress and egress of fluids and other materials into and out of central conduit 116 of tool string 100. For example, junctions between housing 110 and 112 and housing 110 and 114 include one or more O-ring seals 118.

As noted, ball seat valve 102 includes sleeve 106 and split-ring baffle 108. Sleeve 106 is received within housing 110 such that the outer surface of sleeve 106 abuts the inner surface of housing 110. Sleeve 106 is configured to move longitudinally within housing 110. The central passageway of sleeve 106 forms part of central conduit 116 of tool string 100.

Ball seat valve 102 can be actuated within tool string 100 using a variety of mechanisms. In the example of FIG. 2, tool string 100 includes piston 120, which can be configured to actuate ball seat valve 102. Piston 120 is arranged and configured to move within upper housing 112. In the example of tool string 100, upper housing 112 includes a number of apertures 122, which expose central conduit 116 of string 100 to the surrounding formation.

As described further below, when piston 120 moves in a downward direction within upper housing 112, apertures 122 in upper housing 112 are exposed to place ball seat valve 102 in an open state, a state in which fluid communication occurs between the central conduit 116 and the region that surrounds tool string 100. Additionally, movement of piston 120 downward within upper housing 112 can cause piston 120 to engage split-ring baffle 108 and move baffle 108 from the first position within sleeve 106 to the second position, in which baffle 108 assumes a contracted, ball-catching state. In the example of FIG. 2, multiple O-rings 124 circumscribe the outer surface of piston 120 and form corresponding annular seals between the outer surface of piston 120 and the inner surface of upper housing 112, e.g., for purposes of sealing off radial apertures 122 in upper housing 112 when ball seat valve 102 is in the closed state.

Figure 3A:
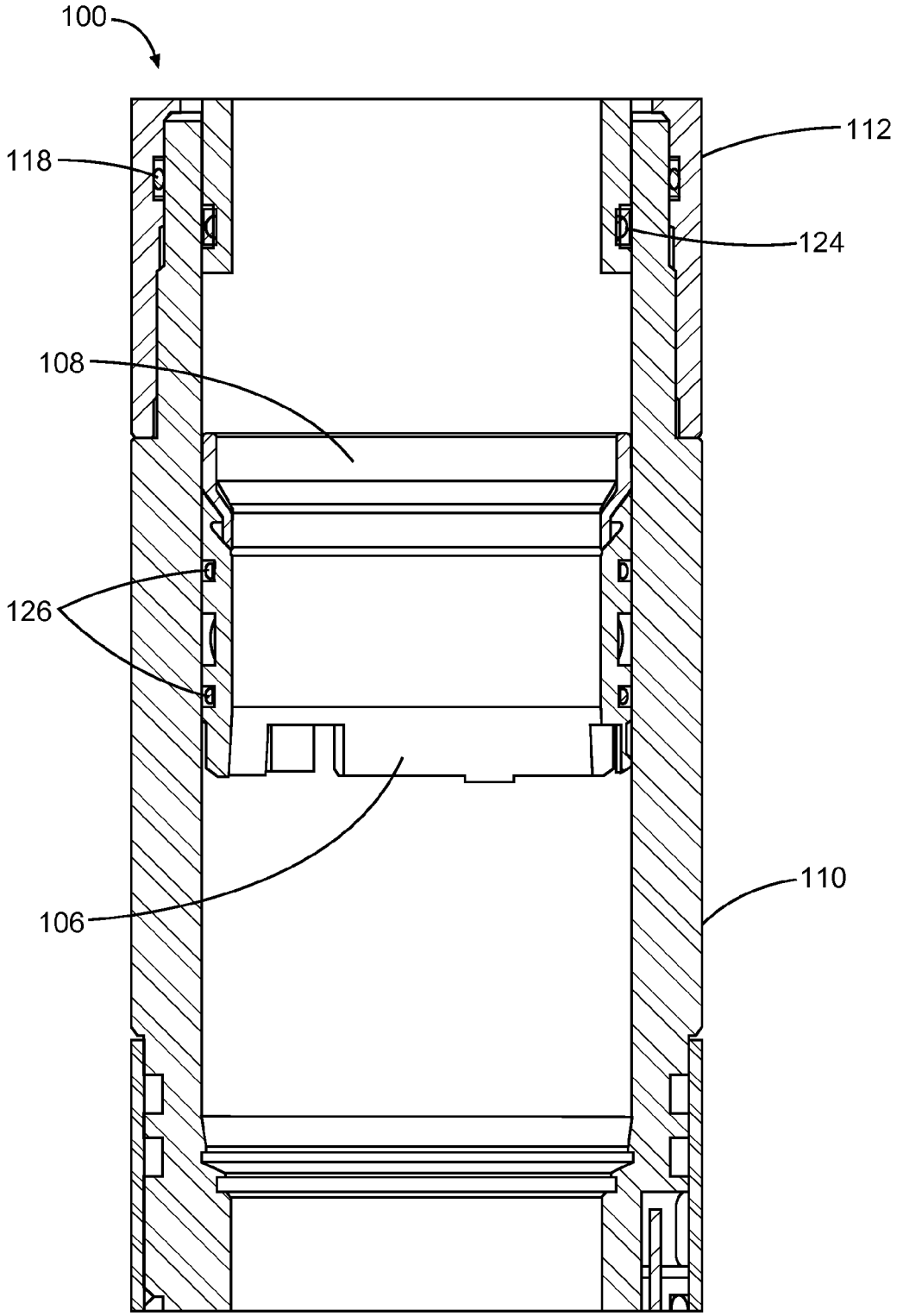
FIGS. 3A-3C depict section views of an example split-ring baffle and annular sleeve arranged within the tool string of FIG. 2.
Figure 3B:
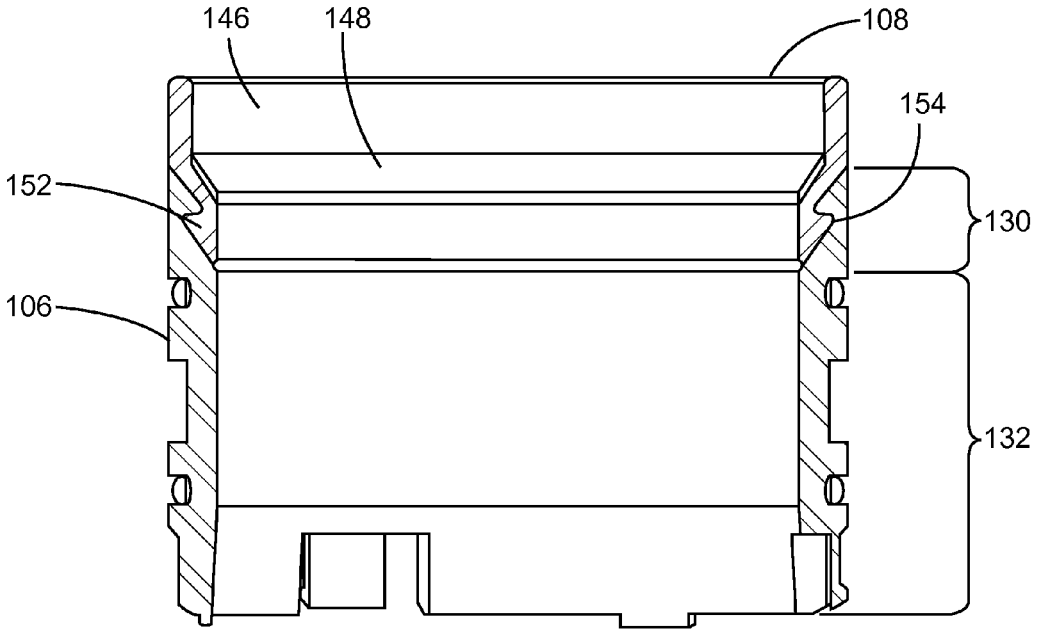
Figure 3C:
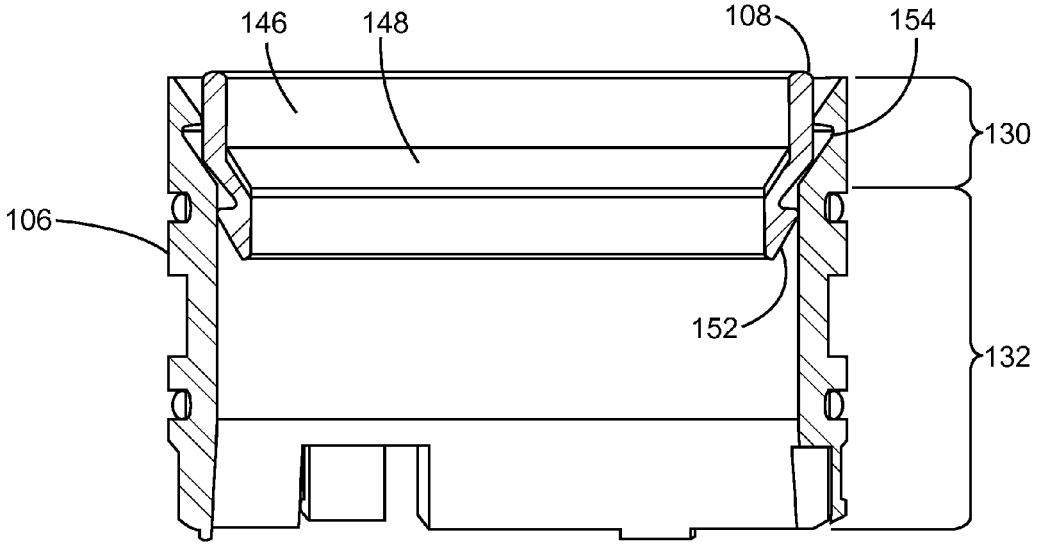
Figure 4A:
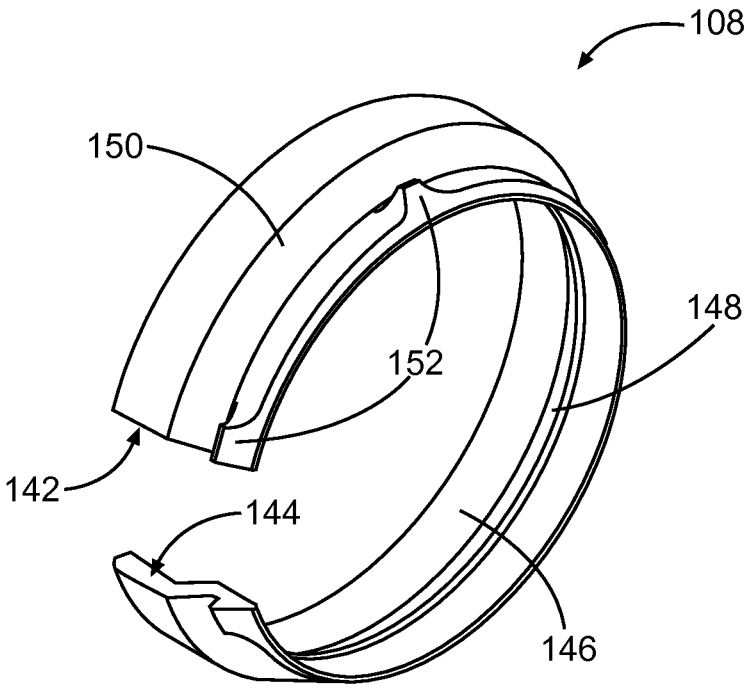
FIGS. 4A and 4B depict perspective views of an example split-ring baffle.
Figure 4B:
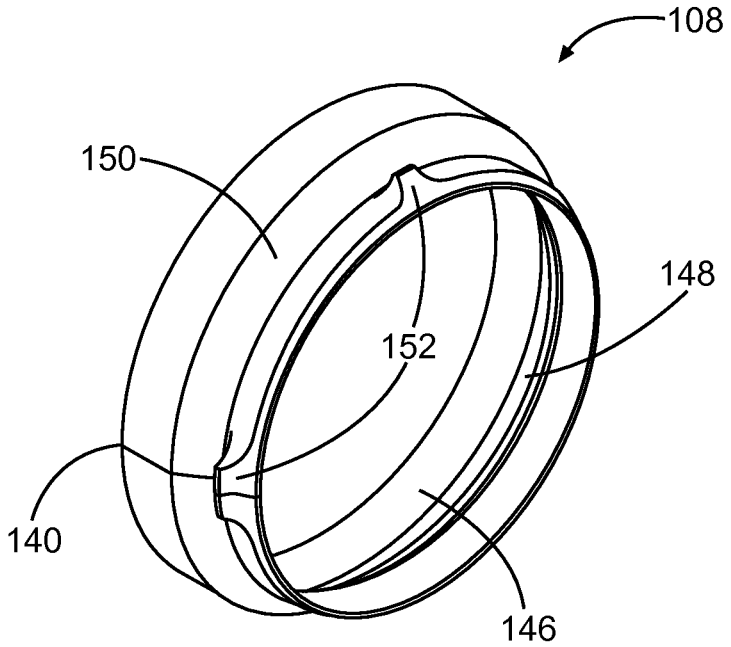

FIGS. 3A-3C depict section views and FIGS. 4A and 4B depict perspective views illustrating the structure of example split-ring baffle 108 of ball seat valve 102 and example sleeve 106 of valve 102 in greater detail. With reference to FIGS. 2-4C, multiple O-rings 126 circumscribe the outer surface of sleeve 106 and form corresponding annular seals between the outer surface of sleeve 106 and the inner surface of upper housing 112. Sleeve 106 includes first section 130 and second section 132. The inner diameter of first section 130 of sleeve 106 is greater than second section 132. The transition between the larger inner diameter of first section 130 of sleeve 106 and the smaller inner diameter of second section 132 is characterized by a generally tapered inner surface of second section 130.

Ball seat valve 102 also includes split-ring baffle 108, which is at least partially received within sleeve 106. Split-ring baffle 108 includes longitudinal seam 140 forming two separate circumferential ends 142, 144 of baffle 108. As will be described in greater detail with reference to FIGS. 5 and 6 and as shown in FIGS. 3A and 3B, split-ring baffle 108 is longitudinally moveable between a first position in first section 130 and a second position in second section 132 of sleeve 106. The outer surface of split-ring baffle 108 is configured to engage the inner surface of sleeve 106 to allow baffle 108 to be expanded in the first position (FIG. 3A), and cause it to be contracted in the second position in the sleeve (FIG. 3B).

The outer surface of split-ring baffle 108 is tapered to engage the tapered portion of the inner surface of first section 130. As split-ring baffle 108 is urged downward within tool string 100, the tapered outer surface of baffle 108 engages the tapered portion of the inner surface of first section 130, which causes split-ring baffle 108 to radially contract. Radially contracting split-ring baffle 108 in this manner by moving baffle 108 from the first position to the second position, places split-ring baffle 108 in the closed, or "ball-catching," state. Thus, in the radially contracted state, split-ring baffle 108 is configured to receive a dropped ball or other plug to restrict fluid flow through central conduit 116 of tool string 100. Once the ball is lodged in split-ring baffle 108, fluid pressure can be applied from the surface of the well for purposes of exerting a downward force on the ball.

FIGS. 4A and 4B depict split-ring baffle 108 in the radially expanded and contracted states, respectively. As illustrated in FIGS. 4A and 4B, as split-ring baffle 108 contracts from the expanded state, circumferential ends 142, 144 formed by longitudinal seam 140 are progressively moved closer to one another. In the contracted state illustrated in FIG. 4B, circumferential ends 142, 144 of baffle 108 abut one another at seam 140. In some examples, however, circumferential ends 142, 144 may be offset from one another by a small distance even when baffle 108 is in the contracted state.

The tapered portion of the outer surface of split-ring baffle 108 is defined by tapered surface 150 and tapered tabs 152. Tapered tabs 152 protrude outward from and are distributed around the circumference of one end of split-ring baffle 108. Example split-ring baffle 108 includes four tabs 152 distributed evenly around the circumference of split-ring baffle 108. In other examples, a split-ring baffle in accordance with this disclosure can include more or fewer tabs that are evenly or unevenly distributed around the circumference of the baffle.

Tapered tabs 152 of split-ring baffle 108 can serve a number of functions. Tabs 152 provide a mechanical stop that can inhibit or prevent baffle 108 from moving axially upward and out of sleeve 106. As illustrated in FIGS. 3A and 3B, tapered tabs 152 are configured to be received by and engage tapered groove 154 in the tapered portion of second section 132 of sleeve 106. As split-ring baffle 108 moves from the second position within sleeve 106 to the first position within sleeve 106, tabs 152 of baffle 108 are configured to engage groove 154 in sleeve 106, as baffle 108 expands. When split-ring baffle 108 is in the second position and expanded, tapered grooves 152 are received in and mate with tapered groove 154.

Tapered tabs 152 can provide another function for split-ring baffle 108 in addition to stopping baffle 108 from axial translation beyond sleeve 106. As will be described in more detail below, when split ring baffle 108 is radially contracted and seated with a ball or other plug and ball seat valve 102 is opened during fracking operations, the pressure within central conduit 116 of tool string 100 can reach high levels, e.g., between approximately 3000 to approximately 5000 pounds per square inch (psi). In such situations, when split-ring baffle 108 is in the second position within sleeve 106 and radially contracted, the pressure within conduit 116 of string 100 can cause the lower end of baffle 108 to deflect radially outward. In the event the deflection of the baffle 108 persists and increases past a threshold, the ball seated within split-ring baffle 108 can become dislodged and flow through baffle 108 and sleeve 106, thereby opening the fluid restriction achieved by the baffle and preventing further fracking operations.

Tapered tabs 152 protrude radially outward and structurally support the lower end of split-ring baffle 108 when baffle 108 is in the contracted, ball-catching state. Tabs 152 provide a structure interposed between the lower end of split-ring baffle 108 and the inner surface of sleeve 106, which can act to inhibit or prevent the lower end of baffle 108 from deflecting radially outward. Split-ring baffle 108 can be configured to withstand the pressure within central conduit 116 of tool string 100, which can reach high levels, including, e.g., between approximately 1000 to approximately 5000 psi. In some examples, an estimated maximum pressure within central conduit 116 of tool string 100 is between approximately 3000 and 5000 psi. However, more commonly, split-ring baffle 108 can be configured to withstand pressures between approximately 1000 and 2500 psi.

In ball seat valves employed in subterranean fracking operations and other such applications, there is a need for collapsible and re-expandable baffles for use in, e.g., sliding sleeve fracking tools, such as split-ring baffle 108 and other split-ring baffles in accordance with this disclosure. Wells made with, for example, 4.5 inch casing, balls dropped at the surface preferably have a diameter less than 3.5 inches, so the ball can travel through the conduit of the tool string. In such applications, tool string inner diameters, e.g., the diameter of central conduit 116 of tool string 100, may have a need for a diameter equal to or greater than 3.75 inches. Due to these two factors, a baffle employed as the ball seat in a ball seat valve ideally is capable of collapsing from a large diameter of approximately 3.75 inches to a smaller diameter equal to or less than approximately 3.443 inches. The relatively large amount of baffle diameter travel, which is equal to 0.45 inches (3.75–3.3) in the foregoing example, can significantly complicate the baffle design.

A number of environmental and operational complications are also present in such applications, which can also impact the effectiveness of baffles employed as ball seats in ball seat valves. For example, the environments in which such baffles are employed are often laden with sand. During baffle contraction, segments of the baffle that enable such contraction can accumulate sand, potentially preventing full collapse. Additionally, in cemented wellbore environments, segmented designs will tend to collect cement between the segments of the baffle. Moreover, because multiple fracking stages may be pumped through the baffles before they are contracted, erosion of the baffle components can be a significant concern. Collapsible and re-expandable baffles employed in ball seat valves need to be of sufficient strength and flexibility to support the pressure load during fracking and to allow for contraction and expansion through the relatively large range of diameters. Also, sealing segments of the baffle that enable contraction/re-expansion can be important, because segments in the baffle design are potential points for leakage and any leak points can have a jetting effect, which can quickly erode the ball and baffle.

With the foregoing challenges and operational requirements in mind, split-ring baffle 108 is designed to achieve relatively large changes in diameter between the expanded and contracted states, and is also designed to withstand significant loading during fracking operations. Additionally, split-ring baffle 108 includes a single seam 140, thus reducing or minimizing the number of segments the baffle includes. To achieve large diametrical changes and support high load conditions, in some examples, split-ring baffle 108 is fabricated from a material that allows baffle 108 to compress from a large diameter to a small diameter and support the loads from the ball impact and the load generated from pressure once the ball is on seat and sealing conduit 116 below ball seat valve 102. In general, split-ring baffle 108 can be fabricated from materials with high toughness, or, put another way, materials with high yield strength and low Young's Modulus. The low Young's Modulus enables a larger change in diameter and higher yield strength enables the baffle to support greater loads. Additionally, high yield strength can also assist in allowing larger changes in diameter for split-ring baffle 108.

In one example, split-ring baffle 108 is fabricated from high yield strength and low Young's Modulus steel. Example steels from which split-ring baffle 108 can be fabricated include Society of Automotive Engineers (SAE) steel grades 4140 or 4130, an austenitic nickel-chromium alloy (e.g. an Inconel® alloy from Special Metals Corp. of New Hartford, N.Y.), titanium, and a martensitic stainless steel. In other examples, split-ring baffle 108 can be fabricated from other metals. In one example, to achieve the desired contractibility and load support, split-ring baffle 108 is fabricated from a material with yield strength in a range from approximately 100 ksi to approximately 150 ksi and with Young's Modulus in a range from approximately 16,000 ksi to approximately 30,000 ksi. A split-ring baffle in accordance with this disclosure, including example baffle 108 can thus achieve diametrical changes on the order of approximately 0.25 to approximately 0.50 inches and can withstand stresses due to compression on the order of approximately 120,000 psi or 120 kilo pounds per square inch (ksi). In one example, a split-ring baffle in accordance with this disclosure can withstand stresses due to compression in a range from approximately 70% to approximately 110% of the yield strength of the material from which the baffle is fabricated.

It is desirable to have the section thickness of split-ring baffle 108 as great as possible. Split-ring baffle 108 can, in certain applications, be exposed to the effects of erosion where various fluids are pumped at high rates through central conduit 116 of tool string 100, causing erosion (material losses). Thus, in order to counter or account for such erosion effects, it is beneficial to maximize the section thickness of split-ring baffle 108 to ensure baffle 108 will allow for the maximum erosion possible in a given application. Additionally, a thicker cross section can also enable split-ring baffle 108 to support greater loads, such as loads from the ball, pressure, sealing, etc.

Limiting factors for the cross-sectional thickness of split-ring baffle 108 may be the stress introduced into the part when it is fully compressed coupled with the properties of the material from which baffle 108 is fabricated. A thinner cross-section baffle will be stressed less than a thicker cross-section baffle, assuming both are compressed to and from the same mid-point diameter. Additionally, it is desirable to maintain a stress on the baffle that is less than the yield strength of the material so the baffle is not plastically deformed. Plastic deformation of the baffle may cause the baffle to have a reduced diameter when it is re-expanded. Further, if it is necessary to exceed the yield strength, the second target could be to limit the stress on the baffle below the ultimate tensile strength of the material from which the baffle is fabricated. If the ultimate tensile strength is exceeded, the baffle can crack or break. Cracks and breakage can also occur even at the yield strength of the material. Thus, in order to reduce the possibility of cracks, breakage, and plastic deformation, it may be best to minimize the stress as much as possible. Thus, in some examples, it may be desirable to design the baffle cross-section thickness such that the stress on the baffle during operation is less than the yield strength of the material from which the baffle is made. In some examples, split-ring baffle 108 is designed such that the stress on baffle 108 during operation is equal to or less than approximately 80% of the yield strength of the material from which baffle 108 is fabricated.

In some examples, the configuration of split-ring baffle 108 can be analytically determined or informed using a mathematical relationship between properties of baffle 108 and the stresses that baffle 108 will encounter during use. For example, assuming a split-ring baffle in accordance with this disclosure is fabricated from a material with a Young's Modulus, E, of 29,000 ksi and a cross-section thickness, t, an expanded outer diameter, ODE, and a contracted outer diameter, ODC, then the compression stress, σ, on the baffle when in a compressed state can be calculated according to the following formula.

$$\sigma=[E\times t\times(\mathrm{ODE}-\mathrm{ODC})]/[(\mathrm{ODE}-t)\times(\mathrm{ODC}-t)]$$

In the foregoing formula, the section thickness, t, is equal to the wall thickness of the baffle (e.g., [outer diameter–inner diameter]/2). The formula can be employed to calculate stress at one section of the baffle. Therefore, in cases where the baffle includes a varying cross section, the stress can be estimated by calculating stress at a number of axial sections along the baffle.

The foregoing calculated compression stress, a, on the baffle can be compared to the yield and ultimate strengths of the baffle to determine the risk of the baffle cracking and/or fracturing. For example, the foregoing calculated compression stress, a, on the baffle can be compared to the yield strength of the baffle to determine if the compression stress is equal to or less than approximately 80% of the yield strength.

One feature of split-ring baffle 108 that affects the cross-section thickness is tapered tabs 152. As illustrated in FIG. 4A and as noted above, split-ring baffle 108 includes intermittent tapered tabs 152 protruding from the circumference of baffle 108. Intermittent tabs 152 are employed with split-ring baffle 108, instead of, e.g., a continuous tapered or other shaped lip that extends around the entire circumference of the baffle. Intermittent tabs can be provided in examples according to this disclosure to provide structural support and mechanical interlock functions, while preventing or reducing the risk of baffle 108 cracking and/or fracturing when moving between the radially expanded and contracted states. The presence of a continuous lip around the entire circumference of the baffle may cause stresses in the baffle that exceed design specifications, e.g., exceed 80% of yield strength, which, in turn, can cause cracking and/or fracturing when moving the baffle between the radially expanded and contracted states.

As noted above, during fracturing operations enabled by actuation of ball seat valve 102, fracturing fluid communicated down central conduit 116 of tool string 100 can act to erode split-ring baffle 108 when there are any potential fluid pathways in baffle 108 other than the central conduit through the baffle. As such, portions of split-ring baffle 108 that are susceptible to leaking can be coated to assist in sealing baffle 108 when in the radially contracted, ball-catching state. For example, inner ball seat surfaces 146 and 148 of split-ring baffle 108 can be coated with rubber to assist in sealing the interface between baffle 108 and a dropped ball from leaking. Additionally, the surfaces of circumferential ends 142, 144 of split-ring baffle 108 can be coated with rubber to provide an improved sealed interface between ends 142, 144 when the ends abut one another at seam 140 in the radially contracted state of baffle 108. A rubber coating on portions of split-ring baffle 144 can also protect the baffle from erosion.

In some examples, a combination of coatings can be employed on portions of split-ring baffle 144. For example, circumferential ends 142 can be coated with a carbide coating or nikel coating, which can then be coated with rubber. The rubber coating applied to baffle 144 can include a Durometer in a range from approximately 40 to approximately 100. In one example, the rubber coating includes a Viton (FKM), Nitrile (NBR), or Hydrogenated Nitrile Butadiene Rubber (HNBR) coating.

Figure 5:
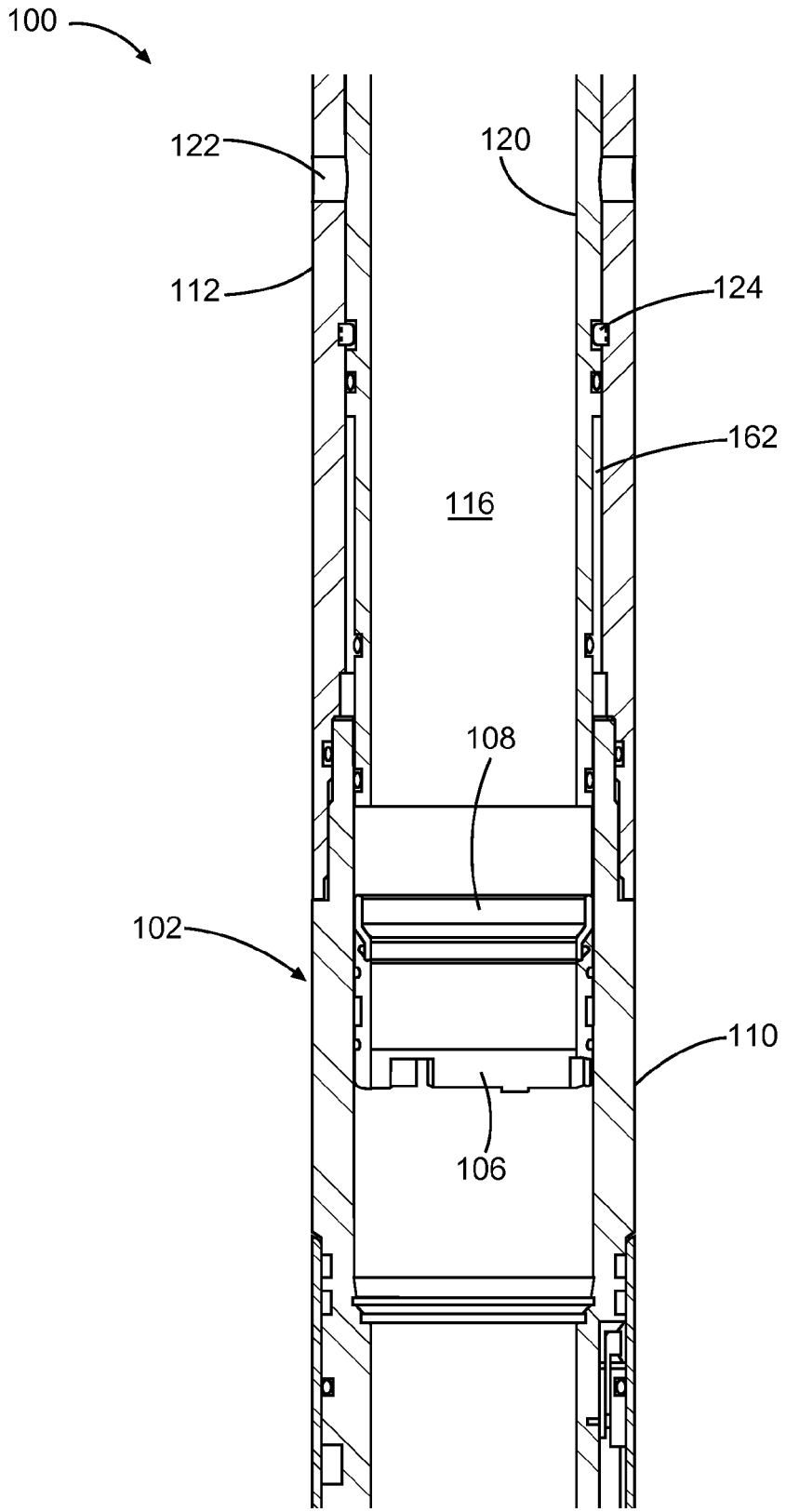
FIG. 5 depicts a section view of a portion of a tool string, which illustrates an example ball seat valve in a closed state with a split-ring baffle expanded within a sleeve.
Figure 6:
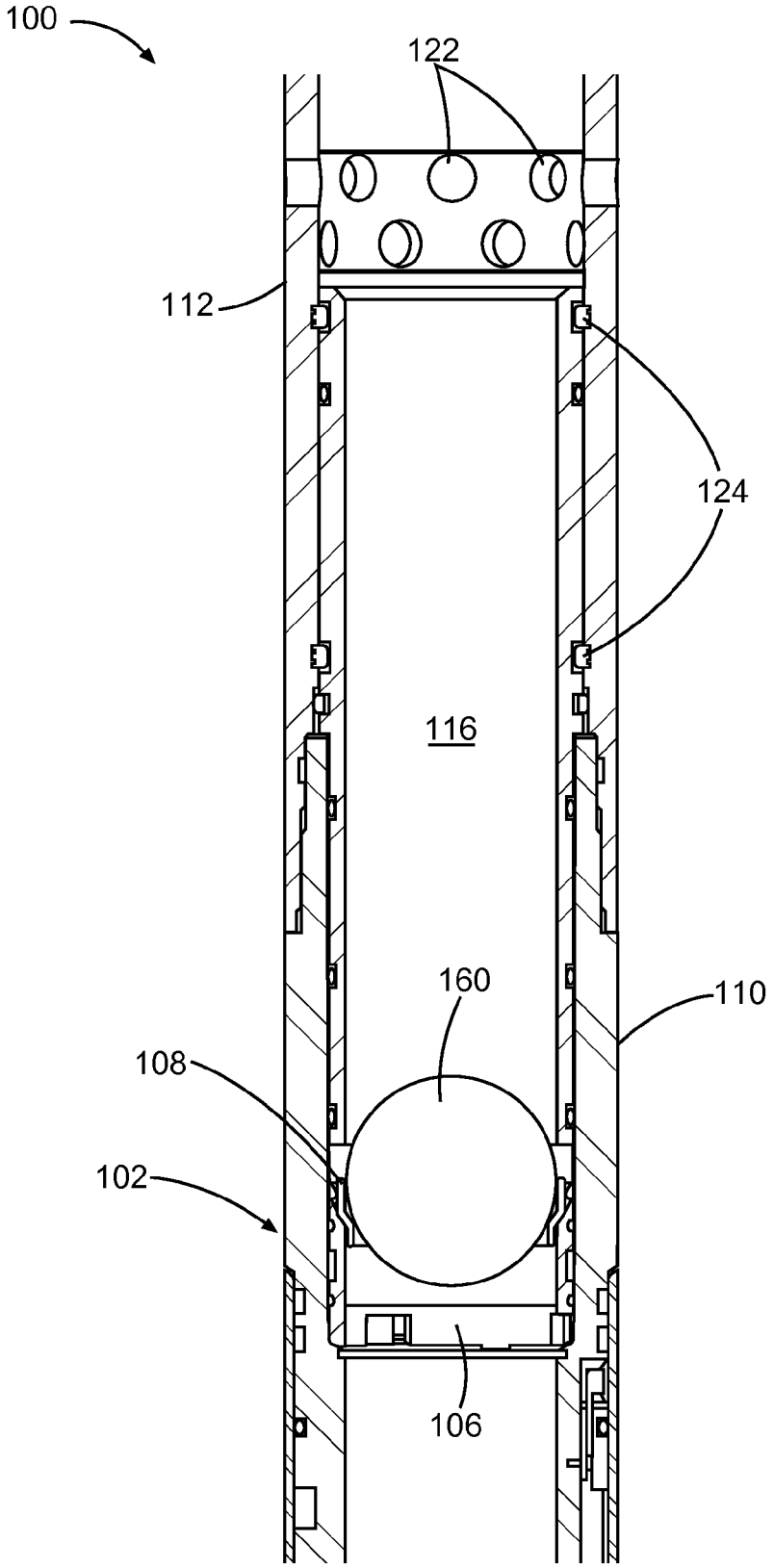
FIG. 6 depicts a section view of a portion of a tool string, which illustrates an example ball seat valve in an open state with a split-ring baffle contracted within a sleeve with a dropped ball seated in the baffle.

Operation of ball seat valve 102 is described with reference to and illustrated in FIGS. 5 and 6, which are both section views of a portion of tool string 100. In FIG. 5, ball seat valve 102 is in a closed state with split-ring baffle 108 expanded in the second position within sleeve 106. In FIG. 6, ball seat valve 102 is open with split-ring baffle 108 contracted in the ball-catching state and with dropped ball 160 seated in baffle 108.

In practice, split-ring baffle 108 is initially deployed in the first position, interlocked with sleeve 106 via tapered tabs 152 and groove 154. Baffle 108 is configured to move within sleeve 106 from the first position to the second position to cause baffle 108 to assume the contracted, ball-catching state. For example, split-ring baffle 108 of ball seat valve 102 is at least partially received within sleeve 106 in the first position. Baffle 108 includes longitudinal seam 140 forming two separate circumferential ends 142, 144 in the baffle. The outer tapered surface of baffle 108 is configured to engage the inner tapered surface of sleeve 106 to cause split-ring baffle 108, when in the first position to be relatively radially expanded, and, when moved to the second position in sleeve 106, to radially contract. Split-ring baffle 108 ball seat of ball seat valve 102 can be engaged to move into the second position in the radially contracted state such that baffle 108 catches dropped ball 160.

Piston 120 arranged and moveable within upper housing 112 of tool string 100 is configured to actuate split-ring baffle 108 to move the baffle from the open, expanded position to the closed, contracted ball-catching state. For example, movement of piston 120 downward within upper housing 112 can cause piston 120 to engage split-ring baffle 108 and move baffle 108 from the first position within sleeve 106 (FIG. 5) to the second position (FIG. 6). In the second position, split-ring baffle 108 assumes a contracted, ball-catching state and is configured to catch dropped ball 160.

Movement of piston 120 within tool string 100 can be achieved with a variety of mechanical or electromechanical mechanisms. In one example, piston 120 is dropped within upper housing 112 to engage split-ring baffle 108 using a hydraulic mechanism. In FIG. 5, a small chamber 162 is defined between a portion of the outer surface of piston 120 and the inner surface of upper housing 112. Chamber 162 can be filled with a hydraulic fluid such that the presence of the incompressible fluid prevents piston 120 from being pushed downward within upper housing 112. During fracturing operations using tool string 100, the pressure within central conduit 116 remains relatively high, e.g., approximately 2000 psi or more when fracking fluid is not being actively transmitted under pressure through the conduit. Thus, in the absence of the hydraulic fluid in chamber 162, piston 120 would be pushed by the pressure in central conduit 116 from the position in FIG. 5 down to the position in FIG. 6.

In one example, therefore, piston 120 is dropped within upper housing 112 to engage split-ring baffle 108 by evacuating the hydraulic fluid from chamber 162. When the hydraulic fluid in chamber 162 is removed or substantially removed, the pressure within chamber 162 holding piston 120 in position is reduced, creating a pressure imbalance between the pressure within central conduit 116 of tool string 100 and chamber 162 that causes piston 120 to move down within upper housing 112. Eventually piston 120 engages split-ring baffle 108 to move baffle 108 into the contracted, ball-catching state illustrated in FIG. 6.

The hydraulic fluid can be removed from chamber 162 to actuate piston 120 in a variety of ways. In one example, the hydraulic fluid is evacuated from chamber 162 by piercing a membrane that covers an outlet port of chamber 162. However, in another example, a small mechanical door or valve can be actuated to open a fluid outlet to remove the hydraulic fluid from chamber 162. For example, an electromagnetic mechanism can be employed to pierce the membrane to evacuate the hydraulic fluid from chamber 162 and, thereby, actuate piston 120.

In one example, to actuate piston 120, a magnetic device is deployed within a chamber or other passage in tool string 100 that is adjacent to an actuator that is employed to evacuate the hydraulic fluid from chamber 162. The magnetic device can be a ferromagnetic cylinder or other shaped ferromagnetic material like a ball, dart, plug, fluid, gel, etc. In one example, a ferrofluid, magnetorheological fluid, or any other fluid having magnetic properties could be pumped to or past a magnetic sensor in order to transmit a magnetic signal to the actuator. Once deployed, the signal(s) generated by the magnetic device can be detected by a magnetic sensor in tool string 100.

In the event the magnetic sensor detects a signature signal that corresponds to deployment of the magnetic device, electronics incorporated into tool string 100 can be configured to engage the actuator to open the valve, which functions to evacuate the hydraulic fluid from chamber 162 to actuate piston 120 to move within housing 112. For example, if the electronic circuitry determines that the sensor has detected a predetermined magnetic signal(s), the electronic circuitry causes a valve device to open. In one example, the valve device includes a piercing member which pierces the membrane that covers an outlet port of chamber 162. The piercing member that is engaged to pierce the membrane sealing chamber 162 can be driven by any means, such as, by an electrical, hydraulic, mechanical, explosive, chemical or other type of actuator. Additional details about and examples of such electro-hydraulic valves are described in U.S. Publication No. 2013/0048290, entitled "INJECTION OF FLUID INTO SELECTED ONES OF MULTIPLE ZONES WITH WELL TOOLS SELECTIVELY RESPONSIVE TO MAGNETIC PATTERNS," which was filed on Aug. 29, 2011.

In the example of ball seat valve 102, piston 120 also forms a component of valve 102 in that movement of piston 120 within upper housing 112 functions to open valve 102. For example, prior to being actuated, piston 120 covers and seals central conduit 116 of tool string 100 from apertures 122, which is illustrated in FIG. 5. When piston 120 is actuated by evacuating chamber 162, or by some other mechanism, to move down, apertures 122 in housing 112 are exposed to place ball seat valve 102 in an open state, as illustrated in FIG. 6. In the state illustrated in FIG. 6, ball seat valve 102 is fully actuated with dropped ball 160 seated in contracted baffle 108 and piston 120 actuated to expose apertures 122. In this state, fluid communication can occur between central conduit 116 of tool string 100 and the region that surrounds the tool string, e.g., the formation surrounding the tool within the wellbore. Fracking fluid can then be communicated downhole, through central conduit 116 and can exit apertures 122 to strike the layer of the formation surrounding tool string 100.

In the foregoing example, movement of piston 120 down within upper housing 112 exposes apertures 122 and, thereby, functions to open ball seat valve 120. In another example, however, movement of the sleeve within which the ball seat is arranged may function to open a ball seat valve in accordance with this disclosure. For example, movement of sleeve 106 can cause apertures in housing 110 to be exposed, which can function to open the ball seat valve. In such an example, sleeve 106 can be caused to move within housing 110 either as a result of force exerted by piston 120 or as a result of fluid pressure on sleeve 106 after ball 160 has been dropped and lodged in baffle 108.

Figure 7:
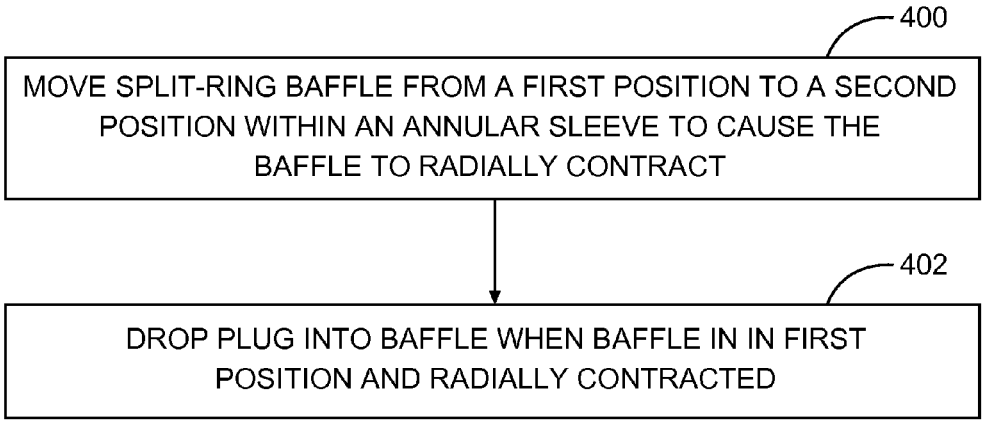
FIG. 7 is a flowchart illustrating an example method of actuating an apparatus for restricting fluid flow through a downhole tubular member.

FIG. 7 depicts a flowchart illustrating an example method of actuating an apparatus for restricting fluid flow through a downhole tubular member. The example method of FIG. 7 includes moving a split-ring baffle from a first position within a first section of an annular sleeve to a second position within a second section of the sleeve to cause the baffle to radially contract (400) and dropping a plug into the baffle when the baffle is in the second position and relatively radially contracted (402). The sleeve includes an inner surface defining the first section of a first diameter and the second section of a second, smaller, diameter. The baffle includes a longitudinal seam forming two separate circumferential ends in the baffle. An outer surface of the baffle is configured to engage the inner surface of the sleeve to cause the baffle, when in the first position to be relatively radially expanded, and, when moved to the second position in the sleeve, to radially contract. The plug is configured to lodge in the baffle to restrict fluid flow through the baffle when the baffle is contracted.

The method of FIG. 7 may form part of a process by which a ball seat valve in a tool string is closed to restrict fluid flow within a portion of the tool string and to communicate a fracturing fluid out of the tool string to engage a zone of formation surrounding the string. An example of the method of FIG. 7 is described above with reference to FIGS. 5 and 6, which illustrate actuation of ball seat valve 102 including split-ring baffle 108, annular sleeve 106, and ball 160 arranged within housing 110 of tool string 100.

Various examples have been described. These and other examples are within the scope of the following claims.

I claim:

1. An apparatus for restricting fluid flow through a downhole tubular member, the apparatus comprising:

an annular housing configured for use in a wellbore;

an annular sleeve configured to be received within the housing, the annular sleeve having an inner surface defining a first section of a first diameter and a second section of a second, smaller, diameter; and a resilient split-ring baffle at least partially received within the sleeve, the baffle comprising a longitudinal seam forming two separate circumferential ends in the baffle, the baffle being longitudinally moveable between a first position in the first section and a second position in the second section of the sleeve, wherein an outer surface of the baffle is configured to engage the inner surface of the sleeve to cause the baffle, when in the first position to be relatively radially expanded, and, when moved to the second position in the sleeve, to radially contract, wherein the sleeve is configured to move longitudinally from a first position toward a second position within the housing in response to an applied force, and wherein the housing comprises a plurality of apertures, which are covered when the sleeve is in the first position and uncovered when the sleeve is in the second position within the housing.

2. The apparatus of claim 1, wherein the two circumferential ends of the baffle are offset from one another when the baffle is expanded and abut one another when the baffle is contracted.

3. The apparatus of claim 1, wherein the two circumferential ends of the baffle are offset from one another by a first distance when the baffle is expanded and are offset from one another by a second distance that is less than the first distance when the baffle is contracted.

4. The apparatus of claim 1, wherein:

a first longitudinal end of the sleeve comprises the inner surface, the inner surface comprising a tapered profile that defines a transition between the first section of the first diameter and the second section of the second, smaller, diameter;

at least a portion of a first longitudinal end of the baffle is received within the first longitudinal end of the sleeve; and the first longitudinal end of the baffle comprises an outer surface comprising a tapered profile configured to engage the tapered profile of the first longitudinal end of the sleeve to cause the baffle, when moved to the first position in the first section of the sleeve, to radially expand, and, when moved to the second position in the second section of the sleeve, to radially contract.

5. The apparatus of claim 4, further comprising a piston configured to be received within the housing, wherein the piston is configured to move longitudinally within the housing to engage the baffle to move the baffle from the first position in the first section of the sleeve to the second position in the second section of the sleeve.

6. The apparatus of claim 5, wherein:

the movement of the piston within the housing to engage the baffle to move the baffle from the first position in the first section of the sleeve to the second position in the second section of the sleeve causes the apertures in the housing to be uncovered.

7. The apparatus of claim 4, wherein:

the outer surface of the first longitudinal end of the baffle comprises a tapered surface and at least one tab protruding radially outward from the outer surface;

the inner surface of the first longitudinal end of the sleeve comprises a groove around the circumference of the inner surface; and the at least one tab configured to be received in and engage the groove.

8. The apparatus of claim 6, wherein the at least one tab comprises a plurality of tabs protruding radially outward from and distributed around the circumference of the outer surface of the first longitudinal end of the baffle.

9. The apparatus of claim 6, wherein the at least one tab comprises an outer tapered surface defining at least a portion of the tapered profile of the outer surface of the first longitudinal end of the baffle, and wherein the groove comprises an inner tapered surface defining at least a portion of the tapered profile of the inner surface of the first longitudinal end of the sleeve.

10. An apparatus for communicating a fracturing fluid to one or more layers of a formation surrounding a subterranean wellbore, the apparatus comprising:

a tool string comprising a plurality of annular housings defining a central conduit of the tool string through which the fracturing fluid is communicated;

an annular sleeve configured to be received within one housing of the tool string, the annular sleeve having an inner surface defining a first section of a first diameter and a second section of a second, smaller diameter; and a resilient split-ring baffle at least partially received within the sleeve, the baffle comprising a longitudinal seam forming two separate circumferential ends in the baffle, the baffle being longitudinally moveable between a first position in the first section and a second position in the second section of the sleeve, wherein an outer surface of the baffle is configured to engage the inner surface of the sleeve to cause the baffle, when in the first position to be relatively radially expanded, and, when moved to the second position in the sleeve, to radially contract, wherein the sleeve is configured to move longitudinally from a first position toward a second position within the one housing in response to an applied force, and wherein the one housing comprises a plurality of apertures, which are covered when the sleeve is in the first position and uncovered when the sleeve is in the second position within the one housing.

11. The apparatus of claim 10, wherein the two circumferential ends of the baffle are offset from one another when the baffle is expanded and abut one another when the baffle is contracted.

12. The apparatus of claim 10, wherein the two circumferential ends of the baffle are offset from one another by a first distance when the baffle is expanded and are offset from one another by a second distance that is less than the first distance when the baffle is contracted.

13. The apparatus of claim 10, wherein:

a first longitudinal end of the sleeve comprises the inner surface, the inner surface comprising a tapered profile that defines a transition between the first section of the first diameter and the second section of the second, smaller, diameter;

at least a portion of a first longitudinal end of the baffle is received within the first longitudinal end of the sleeve; and the first longitudinal end of the baffle comprises an outer surface comprising a tapered profile configured to engage the tapered profile of the first longitudinal end of the sleeve to cause the baffle, when moved to the first position in the first section of the sleeve, to radially expand, and, when moved to the second position in the second section of the sleeve, to radially contract.

14. The apparatus of claim 13, further comprising a piston at least partially received within the one housing of the tool string within which the annular sleeve is received, wherein the piston is configured to selectively move longitudinally within the one housing to engage the baffle to move the baffle from the first position in the first section of the sleeve to the second position in the second section of the sleeve.

15. The apparatus of claim 14, wherein:

the movement of the piston within the housing to engage the baffle to move the baffle from the first position in the first section of the sleeve to the second position in the second section of the sleeve causes the apertures in the housing to be uncovered.

16. The apparatus of claim 14, further comprising an electro-hydraulic valve that is configured to be actuated to selectively move the piston longitudinally within the one housing.

17. The apparatus of claim 14, wherein:

the outer surface of the first longitudinal end of the baffle comprises a tapered surface and at least one tab protruding radially outward from the outer surface;

the inner surface of the first longitudinal end of the sleeve comprises a groove around the circumference of the inner surface; and the at least one tab configured to be received in and engage the groove.

18. The apparatus of claim 17, wherein the at least one tab comprises an outer tapered surface defining at least a portion of the tapered profile of the outer surface of the first longitudinal end of the baffle, and wherein the groove comprises an inner tapered surface defining at least a portion of the tapered profile of the inner surface of the first longitudinal end of the sleeve.

19. A method of actuating an apparatus for restricting fluid flow through a downhole tubular member, the method comprising:

moving a split-ring baffle from a first position within a first section of an annular sleeve to a second position within a second section of the sleeve to cause the baffle to radially contract, wherein the sleeve comprises an inner surface defining the first section of a first diameter and the second section of a second, smaller, diameter, wherein the baffle comprises a longitudinal seam forming two separate circumferential ends in the baffle, and wherein an outer surface of the baffle is configured to engage the inner surface of the sleeve to cause the baffle, when in the first position to be relatively radially expanded, and, when moved to the second position in the sleeve, to radially contract; and dropping a plug into the baffle when the baffle is in the second position and relatively radially contracted, wherein the plug is configured to lodge in the baffle to restrict fluid flow through the baffle when the baffle is contracted; and moving the sleeve longitudinally from a first position toward a second position within the downhole tubular member, wherein the downhole tubular member comprises a apertures which are covered when the sleeve is in the first position and uncovered when the sleeve is in the second position within the downhole tubular member.

* * * * *